US010934777B1

(12) United States Patent
Whitehurst

(10) Patent No.: US 10,934,777 B1
(45) Date of Patent: Mar. 2, 2021

(54) DURABLE LADDER BUMPER GUARD

(71) Applicant: Byron Lee Whitehurst, Williamsburg, VA (US)

(72) Inventor: Byron Lee Whitehurst, Williamsburg, VA (US)

( * ) Notice: Subject to any disclaimer, the term of this patent is extended or adjusted under 35 U.S.C. 154(b) by 0 days.

(21) Appl. No.: 16/395,158

(22) Filed: Apr. 25, 2019

Related U.S. Application Data

(63) Continuation-in-part of application No. 15/403,429, filed on Jan. 11, 2017, now abandoned.

(51) Int. Cl.
*E06C 7/48* (2006.01)

(52) U.S. Cl.
CPC ..... *E06C 7/48* (2013.01)

(58) Field of Classification Search
CPC ..... E06C 1/04; E06C 7/48; E06C 7/46; B29C 45/14; B29C 45/14336; Y10S 264/83
USPC ..... 264/273, 274, 271.1
See application file for complete search history.

(56) References Cited

U.S. PATENT DOCUMENTS 755,713 A * 3/1904 Shanahan ..... E06C 7/46 182/110
1,109,452 A * 9/1914 Morrison ..... E06C 7/46 182/110
1,600,103 A * 9/1926 Evans ..... E06C 7/46 182/108
2,637,063 A * 5/1953 Becker ..... A47B 91/04 16/42 R
2,902,128 A 9/1959 Boham et al.
2,904,128 A * 9/1959 Boham ..... E06C 7/48 182/108
3,115,212 A * 12/1963 Keatiey ..... E06C 7/48 182/108
3,199,819 A * 8/1965 Widmark ..... A47B 91/06 248/188.9
3,505,724 A * 4/1970 Sator ..... A47B 91/06 29/432.2
3,741,226 A * 6/1973 Urban ..... A61H 3/0288 135/84
3,991,146 A * 11/1976 Barrie ..... B29C 33/123 264/46.7
4,469,194 A * 9/1984 McBride ..... E06C 7/48 182/107
4,630,626 A * 12/1986 Urban ..... A45B 9/04 135/84
4,771,862 A * 9/1988 Garland ..... E06C 7/48 182/108
4,899,848 A * 2/1990 Parr ..... E06C 7/48 182/108
D334,813 S * 4/1993 Sheftel ..... D25/68
D334,814 S * 4/1993 Sheftel ..... D25/68
5,299,531 A * 4/1994 Dietz ..... A01K 25/00 119/832
5,533,591 A * 7/1996 Kiska ..... E06C 7/48 182/108
5,816,305 A * 10/1998 May ..... A47G 27/0206 150/165

(Continued)

*Primary Examiner* — Katherine W Mitchell
*Assistant Examiner* — Shiref M Mekhaeil
(74) *Attorney, Agent, or Firm* — Berggren Law Offices; William R Berggren

(57) ABSTRACT

A ladder bumper guard comprising a durable flexible shell and a puncture-resistant cap within the shell, the cap configured to fit over a top end of a metal ladder that is configured to contact a building surface.

19 Claims, 5 Drawing Sheets

(56) References Cited

U.S. PATENT DOCUMENTS 6,405,982 B2 * 6/2002 Ferencz ..... A47B 91/06 16/42 R
6,499,563 B1 * 12/2002 Bremick ..... E06C 7/42 182/108
7,000,731 B2 * 2/2006 Swiderski ..... E06C 7/46 182/108
7,108,102 B2 * 9/2006 Woodward ..... E06C 7/48 182/107
D692,594 S * 10/2013 Pasqualini ..... E01F 13/026 D25/133
9,968,194 B2 * 5/2018 Bushey ..... A47B 91/06
2004/0020582 A1 * 2/2004 Swiderski ..... B29C 37/0078 156/92
2004/0154865 A1 * 8/2004 Woodward ..... E06C 7/48 182/108
2006/0053587 A1 * 3/2006 Chase ..... A47B 91/06 16/42 R
2006/0194892 A1 * 8/2006 Ramesh ..... C08J 9/0061 521/134
2007/0221443 A1 * 9/2007 Nelson ..... E06C 7/081 182/108
2009/0007313 A1 * 1/2009 Boorsma ..... A41D 19/01505 2/161.8
2010/0116589 A1 * 5/2010 Mathieson ..... E04D 13/076 182/107
2011/0048854 A1 * 3/2011 Sebring ..... E06C 7/42 182/108
2011/0083243 A1 * 4/2011 Bristrup ..... A41D 13/0543 2/22
2014/0109896 A1 * 4/2014 Codner ..... A47J 33/00 126/9 B
2014/0238777 A1 * 8/2014 Adair ..... E06C 7/46 182/108
2014/0259324 A1 * 9/2014 Behrend ..... A41D 13/0153 2/455
2015/0237992 A1 * 8/2015 Kinskey ..... A45F 3/005 224/681
2017/0100858 A1 * 4/2017 Gellis ..... A41D 19/015
2017/0138513 A1 * 5/2017 Andresen ..... F16L 11/086

* cited by examiner

A

B

C

DURABLE LADDER BUMPER GUARD

FIELD OF THE INVENTION

This invention relates to ladder bumper guards or rail caps.

BACKGROUND OF THE INVENTION

Most ladders are now made of metal instead of wood for strength and weight reasons and many metal ladders are not self-supporting but are designed to lean against an often vertical surface of a building to enable work to be done on or near that surface. These surfaces include, for example, sides of a building such as a house, and walls in a building. Ladders may vary in construction and include, for example, simple ladders and extensile ladders that comprise steps or rungs attached to perpendicular rails with ends that extend beyond the first and last steps, and ladders equipped with U-shaped structures, also called "bull horns", horizontally displaced through the ladder top and able to bracket fragile structures such as windows with ends touching the building surface on both sides of the fragile structure. The ends of the ladders that contact the building surface are a source of damage to that surface through pressure of the ends against the surface or scraping of the ends against that surface. Ladder bumper guards or endcaps have been developed to minimize that damage.

The ladder bumper guards are, typically, rounded plastic or rubber sleeves. The rounded plastic ends may slide off the building surface. The rubber sleeves that slip on the ends of the ladder often have a short life span and they wear out, exposing metal ladder ends that damage the surfaces.

SUMMARY OF THE INVENTION

There is a need for more durable bumper guards for ladder bullhorns or tips. Additionally, there is still a need for attachable durable ladder bumper guards for ladders to minimize adverse marking or slippage on building surfaces. I have invented a durable ladder bumper guard that addresses the current issues of adverse damage, slippage, and an undesirably short functional lifespan. The invention comprises a durable reinforcement cap between the metal ladder ends and the soft outer bumper shell configured to prevent the metal ladder ends from wearing away through the soft bumper material from the inside. Specifically, the invention comprises an article and a method.

The ladder bumper guard includes a shell and a cap. The shell can be configured to affix to a top end of a metal ladder that is to be proximate a building surface. The shell can have an inner surface configured to affix to the top end of the ladder and an outer surface that can be configured to releasably affix to a side of a structure when placed against it. The cap can have an outer surface, an inner surface, a top configured to surround a tip of the top end of the ladder in a cupping form, and sides that extend from the cap top and surround at least a majority of the sides of the top end of the ladder. It can be configured to fit inside the shell and also fit over the tip and top end of the ladder. The cap can include a material that is puncture-resistant and tear-resistant under shear forces from the top end of the ladder that can be experienced under working conditions associated with use of the ladder.

The method of using the ladder bumper guard can include providing a metal ladder with at least one top end configured to contact a building surface that the ladder is placed against during use. The method of use also can also include providing a ladder bumper guard for each top end, the ladder bumper comprising a shell and a cap as described above. A ladder bumper guard can be placed over each of the top ends of the metal ladder to form a protected ladder which can then be placed against the building surface.

The ladder bumper guard can be more durable in use with metal ladders than with ladders currently known. The shell can provide a slip resistant surface when the ladder is placed against a building surface. The cap can protect the shell from the shear forces caused by the pinching of the shell between the ends of the metal ladder and the building surface that the ladder is placed against.

BRIEF DESCRIPTION OF THE DRAWINGS

One or more features or preferred forms of the invention are described in the accompanying drawings. The drawings are described briefly below.

Figure 1:
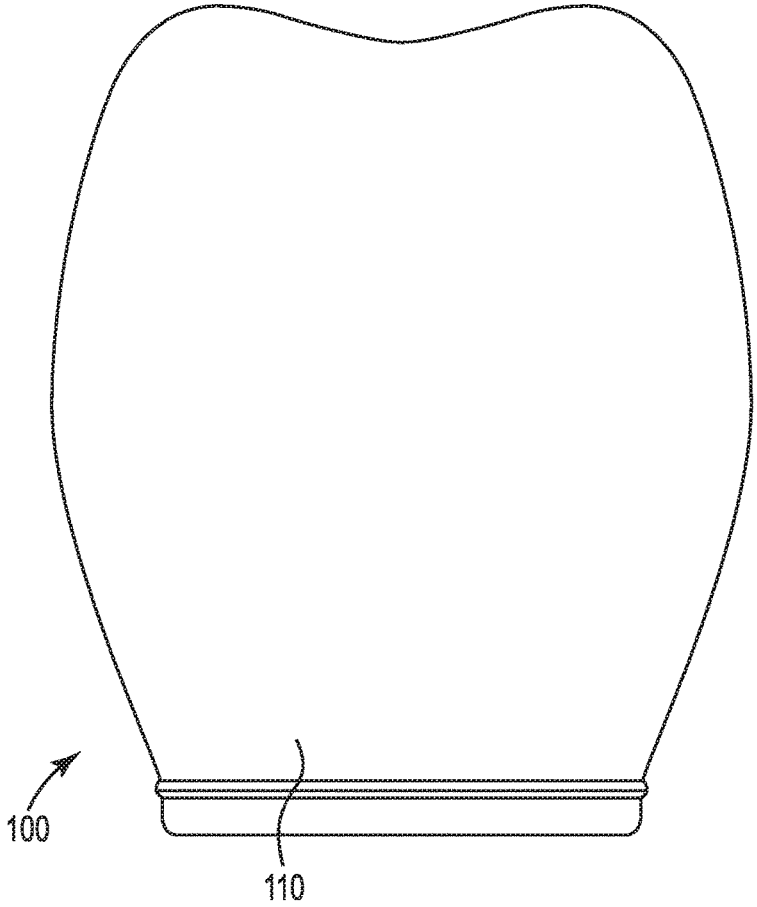
FIG. 1 is a face view of an embodiment of a ladder bumper guard of the invention.

While the invention is amenable to various modifications and alternative forms, specifics thereof have been shown by way of example in the drawings and will be described in detail below. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF SOME EMBODIMENTS OF THE INVENTION

The ladder bumper guard of the invention can eliminate premature wear of the ladder guard during use and minimizes slippage of the ladder on a building surface that it is placed against or adverse marking of that surface.

Ladder guards currently available on the market can break down quickly from day to day beating of heavy duty use. Often constructed of inferior materials and with no reinforcement barrier built in, the ladders have a tendency to break through the outer surface of the ladder guard from the inside, leaving the structure that the ladder is leaning against vulnerable to damage from the metal ends of the ladder. Exposed metal ends made of hollow tubbing will almost always cut into any surface because of the great degree of pressure per square inch exerted on such a small area.

Ladders are generally constructed of metal and come in two forms. One form is a straight ladder with parallel rungs attached to perpendicular rails that extend beyond the first at the bottom and the last rung at the top. A variation of this form is an extension ladder comprising two straight ladders slideably affixed to each other with hooks at the bottom of a first configured to attach to rungs of a second as the first is raised past the top of the second. The top ends of this ladder generally have hard plastic caps on the end that do not protect surfaces of buildings from being marred when the ladder is slid over that surface or pressed into that surface during use. A second form is a straight ladder with a horizontal bar passing through the top portions of the rails of the straight ladder and two bars extending horizontally and perpendicular from the ends of the horizontal bar. The ends of these perpendicular bars contact the building surface being worked upon and are called ladder top ends in this document. This U-shaped horizontal piece is used to enable the ladder contact points with a building surface to bracket or straddle a surface that is unable to support the weight of a ladder, such as, for example, a window, various openings on buildings, and for any purpose that requires that the ladder itself not be pressing directly against the side of a building or home. Home owners and particularly construction contractors use ladders with the U-shaped device routinely when applying siding, painting, window replacements, and a wide range of other tasks. The ends of this form of ladder typically have plastic caps that do not prevent marring of the surface when the ladder ends contacting the surface are scraped or slid over the surface.

The disclosed ladder bumper guard comprises two elements—a shell and a cap. The shell can be configured to affix to a top end of a metal ladder that is to be proximate a building surface. "Affixed" means the shell is able to slide snuggly over the end of the ladder and not be removed by merely shaking the ladder in an upside-down orientation. The ladder bumper guard may be removed by pulling it off the end of the ladder. The shell can have an inner surface configured to affix to the top end of the ladder and an outer surface that can be configured to releasably affix to a side of a structure when placed against it. The shell may be removed from the end of the ladder by pulling it off. The cap can be held onto the end of the ladder by the holding action of the shell that surrounds the cap.

In some embodiments of the invention, the shell is a flexible stretchable material configured to adhere to the end of the ladder proximate the building surface and to resist slipping off the end while the ladder is in use.

In some embodiments, the shell comprises a material that is durable and resistant to the causing of degradation to building surfaces that the shell may contact.

In some embodiments, the shell comprises rubber that is an all-weather, sun resistant material resistant to cracking and corrosion.

The disclosed cap has an outer surface, an inner surface, a top configured to surround a tip of the top end of the ladder in a cupping form, and sides that extend from the cap top and surround at least a majority of the sides of the top end of the ladder. It can be configured to fit inside the shell and also to fit over the tip and top end of the ladder. The cap can comprise a material that is puncture-resistant and tear-resistant under shear forces from the top end of the ladder experienced under working conditions associated with use of the ladder.

In some embodiments, the cap comprises a material that is puncture-resistant to prevent the end of the metal ladder from cutting through the shell during use.

In some embodiments, the cap is configured to distribute the pinching force between the metal end of the latter tip and the building surface over a broad part of the cap surface. In these embodiments, the cap provides more even weight distribution to the outer surface of the cap to eliminate pinch points where excessive force on the shell can exist between the point of greatest proximity of the ladder end to the building surface and the building surface. In some embodiments, the sides are honeycombed with openings to increase force distribution and reduce weight.

In some embodiments, the cap comprises metal or plastic.

In some embodiments, the cap comprises polycarbonate. One type of polycarbonate is LEXAN.

In some embodiments, the cap further comprises at least one opening in its side through its outer and inner surfaces to allow material from the shell to be able to push through toward an end of a ladder when in use to increase gripping of the ladder bumper guard to the top end of the ladder.

In some embodiments where the cap contains at least one opening, the outer surface of the shell comprises a skid resistant pattern on at least the portion of the surface configured to contact a building surface to be worked upon. In some embodiments, the opening may be continuous, such as, for example, an upside down "V" extending from the top cup like portion of the cap downward to the bottom of one or more sides of the cap.

In some embodiments, the shell and cap are affixed to each other. The cap may be molded into the shell or adhered by other methods known to the art.

In some embodiments, the shell and cap are releasably affixed to each other. In these embodiments, the cap may be placed on the ends of the ladder followed by the shell. Alternatively, the cap may be placed in the shell and both may be fitted over the end of the ladder.

In some embodiments, the gripping action of the outer surface of the shell to the building surface that it is use against may be further enhanced by use of a pattern over at least the outer surface of the shell intended to be in contact with the building during use. A pattern having uniform gripping action in both directions orthogonal to each other along the plane of contact is beneficial. In one embodiment the pattern is a diamond with a raised dot in the middle.

A method of using the ladder bumper guard includes providing a metal ladder with at least one top end that can be configured to contact a surface that the ladder is placed against during use. The disclosed method also can include providing a ladder bumper guard for each top end, the ladder bumper comprising a shell and a cap as described above. The the ladder bumper guard can be placed over each of the top ends of the metal ladder to form a protected ladder. The protected ladder can be placed against the surface. In some embodiments, the surface can include the side of a building, the eaves of a building, a tree, a shed, a tall vehicle, a sign, a light pole, or any other surface of an object that a person needs to access. Other modifications of the method can include placing the cap on the end of the ladder and then placing the shell on top of the capped end using caps with openings in its sides and a shell with an inner surface with protruding material configured to fit through the cap openings.

FIGS. 1-10 further describe the invention through illustrations of various embodiments with two forms of ladder.

FIG. 1 is a face view (110) of an embodiment of a ladder bumper guard (100) of the invention.

Figure 2:
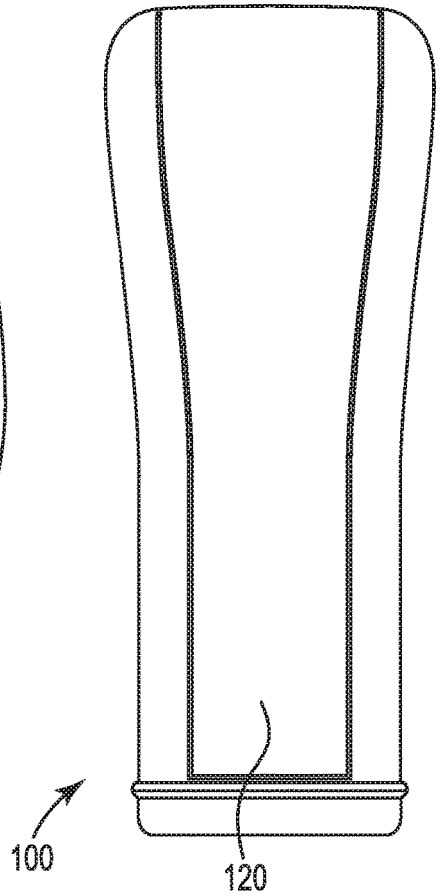
FIG. 2 is a side view of the embodiment of the invention shown in FIG. 1.

FIG. 2 is a side view (120) of embodiment of a ladder bumper guard 100 shown in FIG. 1.

Figure 3:
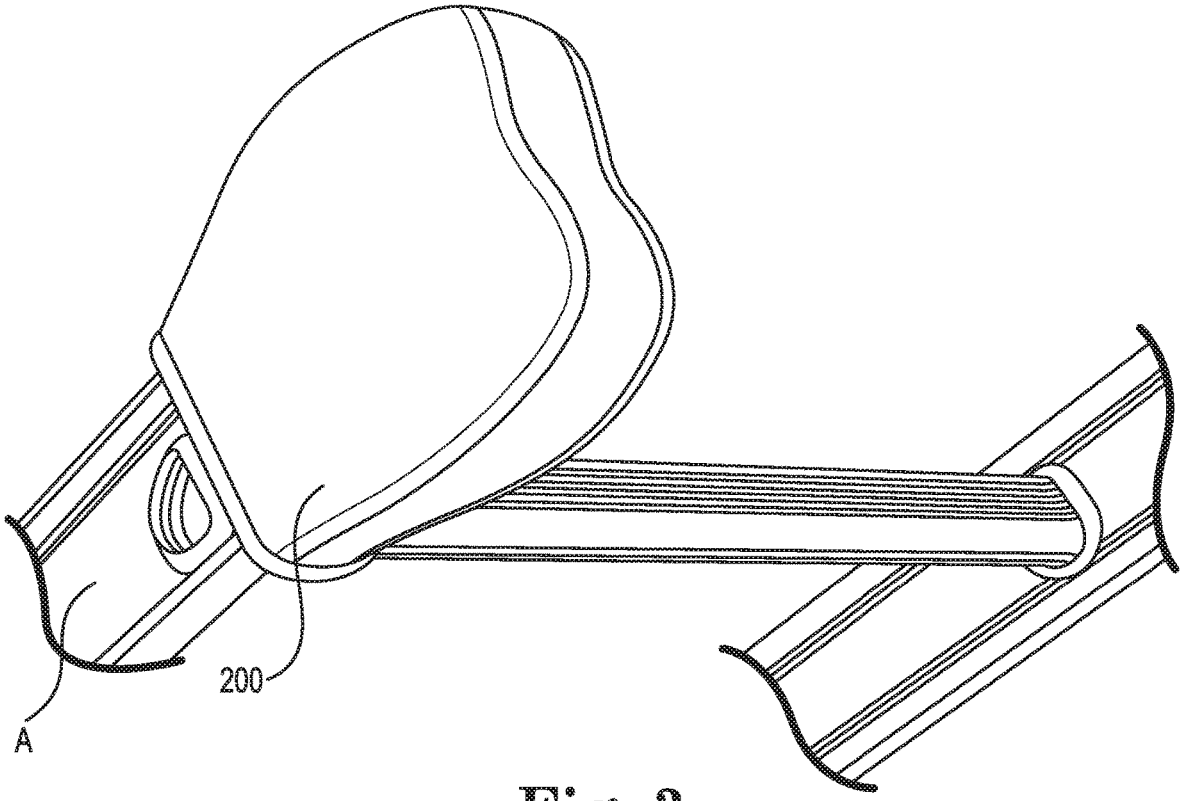
FIG. 3 is a perspective view of an embodiment of the invention shown affixed to a top end of a ladder.

FIG. 3 is a perspective view (200) of an embodiment of the bumper guard shown affixed to a top end of a ladder (A).

Figure 4:
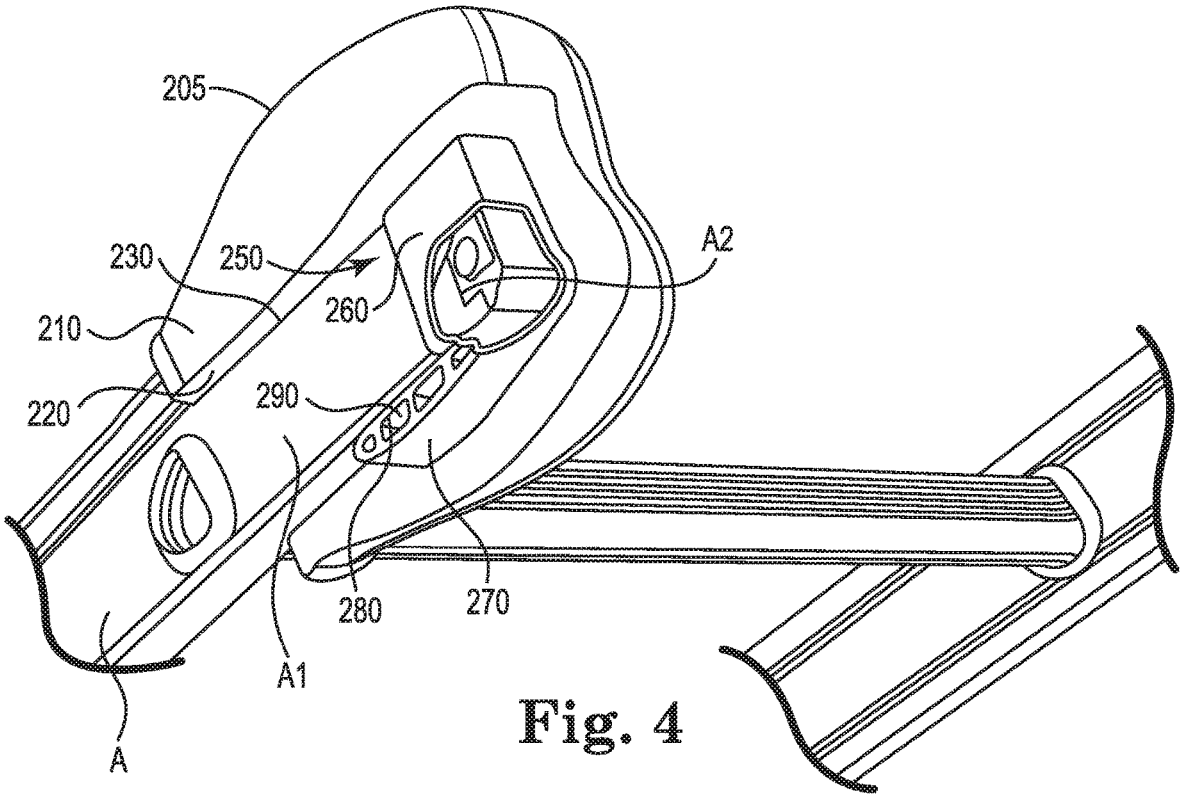
FIG. 4 is a cut-away of a perspective view of an embodiment of the invention shown affixed to a top end of a ladder.

FIG. 4 is a cut-away of a perspective view of an embodiment of the invention shown in FIG. 3. Ladder bumper guard 200 is placed on a top end (A1) of a ladder (A). As shown the ladder bumper guard 200 is composed of a shell (205) with an outer surface (210), a thickness (220), and an inner surface (230) that is in contact with either ladder end A1 or a cap (250). Cap 250 is composed of a cap top (260) enclosing a ladder tip (A2) and cap sides (270) in contact with inner surfaced shell 230 and ladder top end A1. Side 270 has an interior (280) with cavities (290) for distributing force of ladder tip A2 pinching shell (205) and reducing weight.

Figure 5:
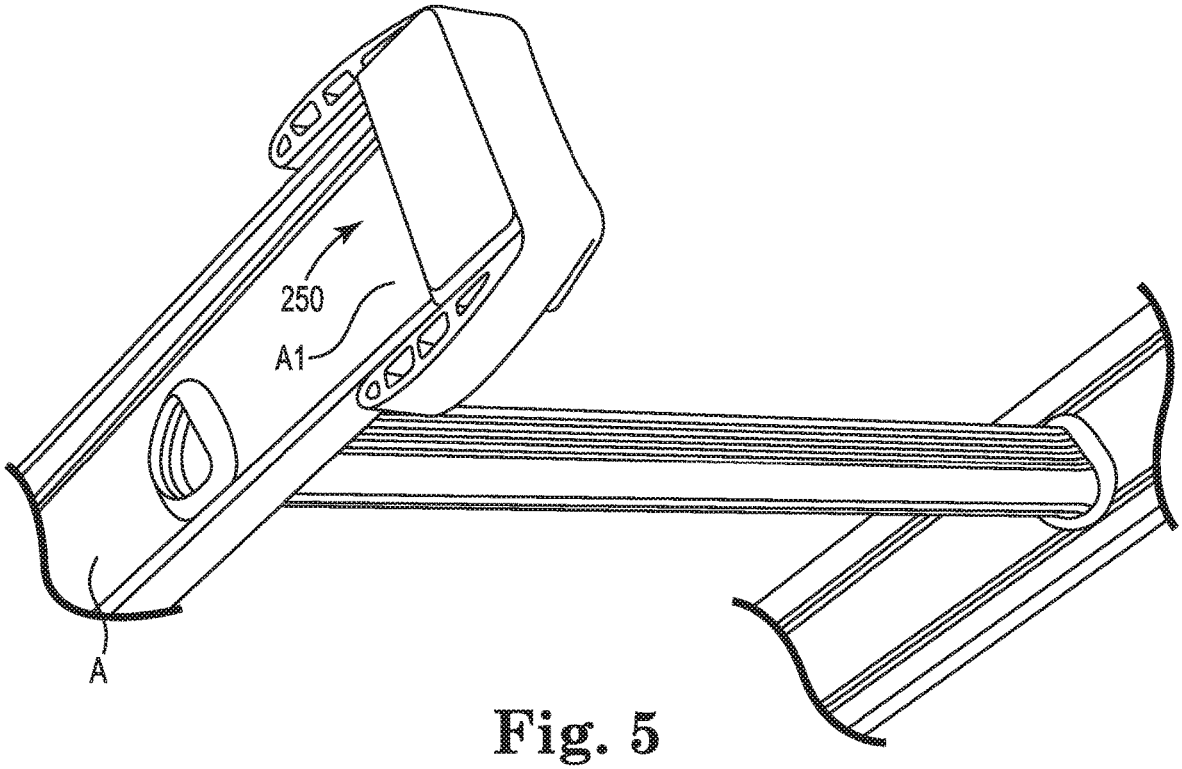
FIG. 5 is a cut-away pf a perspective view of an embodiment of only the cap element of the invention shown affixed to a top end of a ladder.

FIG. 5 is a cut-away perspective view of an embodiment of only the cap element of the invention shown affixed to a top end of a ladder. Shown is Cap 250 on ladder end A1 with the sides 270 cut-away to show interior 280 with cavities 290.

Figure 6:
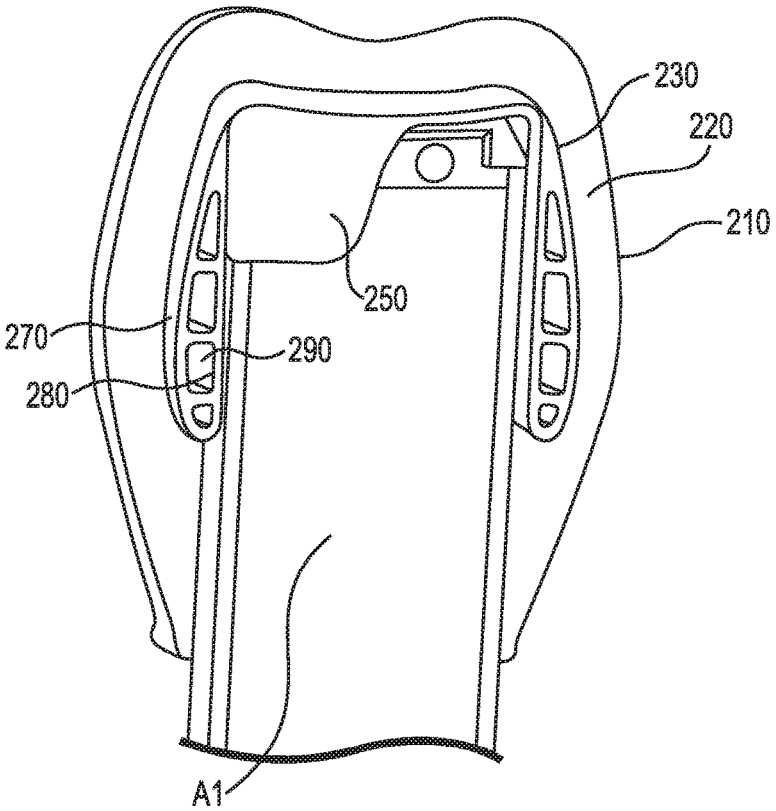
FIG. 6 is a cut-away of a perspective view of an embodiment of only the cap element of the invention shown affixed to a top end of a ladder.

FIG. 6 is a cut-away of a perspective view of only an embodiment of the cap element of the invention shown in FIG. 5. Also shown is shell 205 enveloping cap 250 covered ladder end A1 and extending below cap side 205 to contact ladder end A1 directly in a gripping action.

Figure 7:
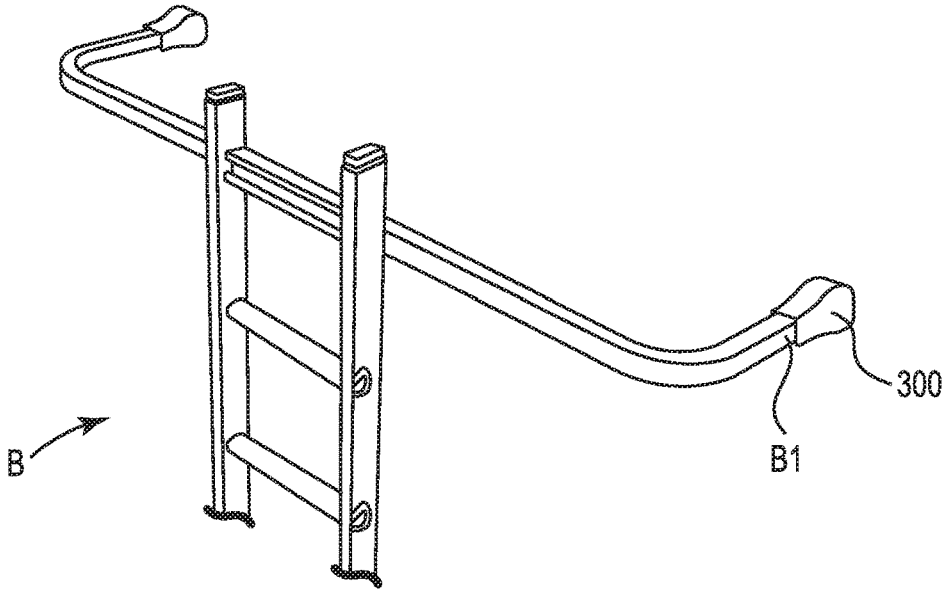
FIG. 7 is an illustration of a ladder with a horizontal U-shaped structure to span such structures as a window while leaned against a building surface.
Figure 8:
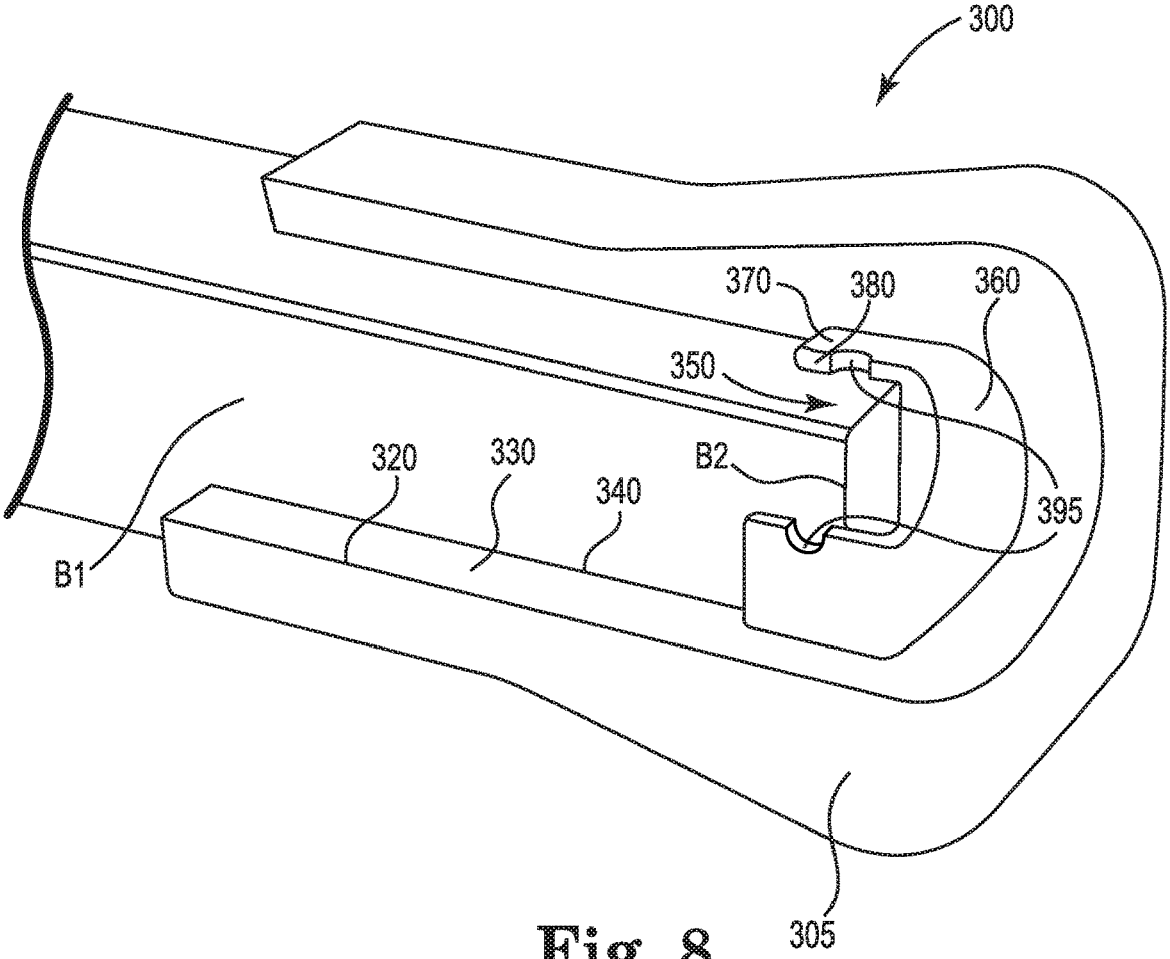
FIG. 8 is a cut-away of a perspective view of an embodiment of the invention shown affixed to a horizontal end of the ladder shown in FIG. 7.

FIG. 7 is an illustration of a ladder (B) with a horizontal U-shaped structure with two ladder tips to span such structures as a window while leaned against a building surface. Also shown embodiments of a ladder bumper guard (300) affixed to each ladder end (B1), FIG. 8 is a cut-away of a perspective view of an embodiment of the invention shown affixed to a horizontal end of the ladder shown in FIG. 7. Ladder bumper guard 300 is shown in a cut-away view. Illustrated is a shell (305) enveloping a cap (350) having a cap top (360) enclosing ladder tip B2 and sides (370) at least partly around ladder end B1. Sides 370 have a thickness (380) that distributes the pinching force throughout cap 350 and openings (395) through the entire cap thickness to allow part of shell 310 to penetrate side 370 to contact ladder end B1 to increase gripping action of ladder bumper guard 300 on ladder end B1.

Figure 9A:
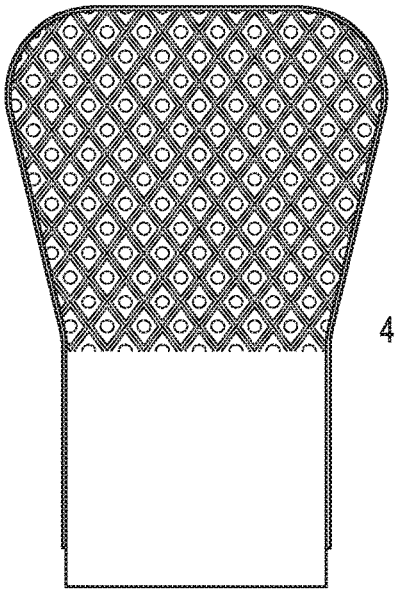
FIGS. 9A and 9C are side views of an embodiment of the invention showing the surface patterning.
Figure 9B:
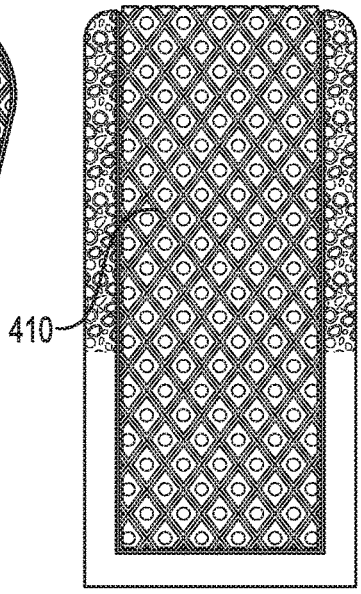
FIG. 9B is a view of the embodiments shown in FIG. 9A.
Figure 9C:
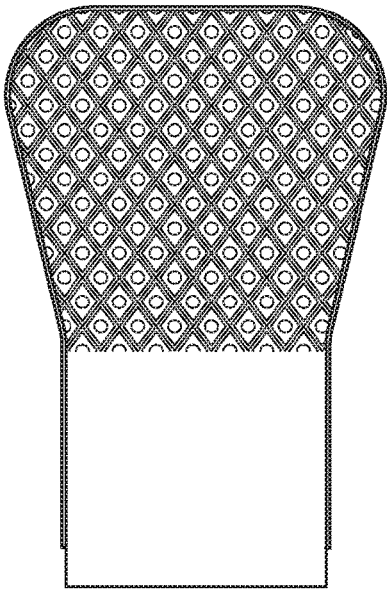
Figure 10:
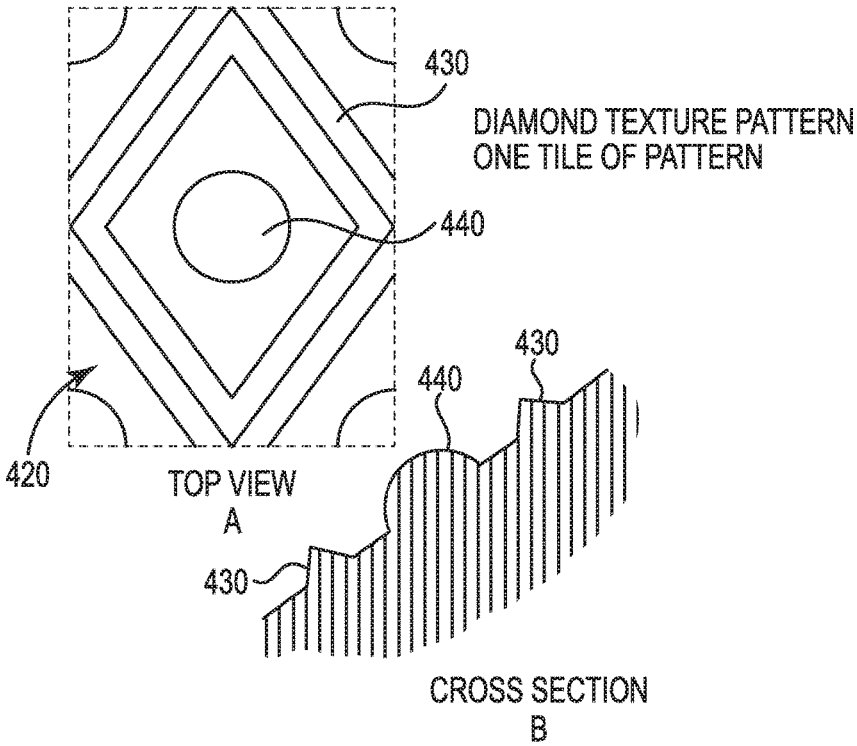
FIGS. 10A and 10B are a top view and a side view respectively of a blowup of one feature of the pattern that is replicated throughout the surface of the invention.

FIGS. 9A and 9C are side views of an embodiment of the invention showing the surface patterning (410).

FIG. 9B is a side view of the embodiments shown in FIG. 9A. FIGS.

FIGS. 10A and 10B are a top view and a side view respectively of a blowup of one feature of the pattern (410) that is replicated throughout the surface of the invention. An individual pattern 420 comprises a diamond shape formed by raised borders with a triangular cross section (430) surrounding a raised half sphere (440).

Other modifications and changes regarding my invention will be apparent to those skilled in the art. The invention is not considered limited to the embodiments chosen for purposes of disclosure and covers all changes and modifications that do not constitute departures from the true spirit and scope of this invention.

I claim:

1. A method of using a ladder bumper guard comprising, providing a metal ladder having at least one top end having a top, an edge and adjacent sides configured to contact a building surface that the ladder is placed against in use;

providing the ladder bumper guard comprising, a shell having a stretchable side that is configured to releasably affix to the top end of the ladder wherein affixed meant to mean able to slide snuggly over the end of the ladder and not be removed by merely shaking the ladder in an upside-down orientation, and a cap configured to surround a tip of the top end of the ladder and having a top configured to surround the tip of the top end of the ladder in the form of an upside down cup, and sides that extend from the cap top and configured to surround at least a majority of the sides of the top end of the ladder to protect the shell from tearing and puncture, wherein the shell envelops and extends below the cap, and the shell and cap are affixed to each other, and said shell extends beyond said cap and is affixed directly to said adjacent sides of said ladder, and wherein the cap is configured to protect the shell from shear forces caused by pinching of the shell between the top end of the ladder and the building surface against which the ladder is placed; and placing the ladder bumper guard over the tip of the top end of the ladder to releasably affix the ladder bumper guard to the tip of the top end of the ladder and to protect the ladder from slipping over or scratching the surface of the building the ladder is placed against.

2. The method of claim 1 further comprising, climbing the ladder to exert pressure on the top end of the ladder against the building surface.

3. The method of claim 1 wherein the cap is releasably affixed to the shell.

4. The method of claim 1 wherein the cap is molded into the shell.

5. The method of claim 1 wherein the cap is adhered to the shell.

6. The method of claim 1 wherein the cap top is a domed top.

7. The method of claim 1 wherein the cap comprises openings that further secures the cap to the shell.

8. The method of claim 1 wherein the stretchable shell comprises a material configured to stretch over and adhere to the cap and the top end of the ladder proximate the building surface and to resist slipping off the top end while the ladder is in use.

9. The method of claim 1 wherein the shell comprises a material that is pliable, and skid resistant so as to not cause marring, scratching, and scrapping of the building surface by undesirable sliding over that building surface during use.

10. The method of claim 1 wherein the shell comprises rubber.

11. The method of claim 1 wherein the shell comprises a skid resistant pattern.

12. The method of claim 11 wherein the skid resistant pattern comprises a diamond pattern with gripping performance in plane perpendicular to the height of the pattern across the outer surface of the shell.

13. The method of claim 1 wherein the cap comprises a material that is puncture resistant under shear forces caused by the ladder tip pressing against the building surface during use to prevent the end of the metal ladder from cutting through the shell during use.

14. The method of claim 13 wherein the cap is configured to distribute the pinching force between the tip of the top end of the ladder and the building surface over a part of the cap.

15. The method of claim 1 wherein the cap comprises metal or plastic.

16. The method of claim 1 wherein the cap comprises polycarbonate.

17. The method of claim 1 wherein the cap further comprises at least one opening through its outer and inner surfaces to allow material from the shell to be able to push through toward an end of the ladder when in use to increase gripping of the ladder bumper guard to the top end of the ladder.

18. The method of claim 1 wherein the cap further comprises cavities that distributes the shear force applied to the cap throughout a greater part of the side of the cap near origination of the shear force.

19. The method of claim 1 wherein the cap further comprises at least one opening that allows material from the shell to protrude through the cap and contact at least a portion of the ladder to increase the grip of the shell to the top end of the ladder.

* * * * *